US011056033B2

(12) United States Patent
Ito

(10) Patent No.: US 11,056,033 B2
(45) Date of Patent: Jul. 6, 2021

(54) ELECTRO-OPTICAL APPARATUS, DISPLAY CONTROL SYSTEM, DISPLAY DRIVER, ELECTRONIC DEVICE, AND MOBILE UNIT

(71) Applicant: SEIKO EPSON CORPORATION, Tokyo (JP)

(72) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/752,733

(22) Filed: Jan. 27, 2020

(65) Prior Publication Data

US 2020/0242989 A1 Jul. 30, 2020

(30) Foreign Application Priority Data

Jan. 28, 2019 (JP) ..... JP2019-012089

(51) Int. Cl.
*G09G 3/18* (2006.01)
*G09G 3/36* (2006.01)

(52) U.S. Cl.
CPC ..... *G09G 3/18* (2013.01); *G09G 3/3648* (2013.01); *G09G 2300/023* (2013.01); *G09G 2380/10* (2013.01)

(58) Field of Classification Search
CPC .. G09G 3/18; G09G 3/3648; G09G 2300/023; G09G 2380/10
See application file for complete search history.

(56) References Cited

U.S. PATENT DOCUMENTS 6,593,901 B1 7/2003 Kitazawa et al.
2019/0018291 A1* 1/2019 Iwamoto ..... G02F 1/136213

FOREIGN PATENT DOCUMENTS

WO 2000/036582 A1 6/2000

* cited by examiner

*Primary Examiner* — Sahlu Okebato
(74) *Attorney, Agent, or Firm* — Oliff PLC

(57) ABSTRACT

An electro-optical apparatus 300 includes a first electro-optical panel 201 that is a segment panel, a first display driver 101 that drives the first electro-optical panel 201, a second electro-optical panel 202 that is a matrix panel, and is arranged to overlap the first electro-optical panel 201 in planar view of the first electro-optical panel 201, and a second display driver 102 that displays an image on the second electro-optical panel 202 by driving the second electro-optical panel 202. The first electro-optical panel 201 is arranged on the side from which an image is visually recognizable. The second display driver 102 outputs a drive voltage to a segment electrode of the first electro-optical panel 201.

14 Claims, 12 Drawing Sheets

ELECTRO-OPTICAL APPARATUS, DISPLAY CONTROL SYSTEM, DISPLAY DRIVER, ELECTRONIC DEVICE, AND MOBILE UNIT

The present application is based on, and claims priority from JP Application Serial Number 2019-012089, filed Jan. 28, 2019, the disclosure of which is hereby incorporated by reference herein in its entirety.

BACKGROUND

1. Technical Field

The present invention relates to an electro-optical apparatus, a display control system, a display driver, an electronic device, a mobile object, and the like.

2. Related Art

Heretofore, display apparatuses provided with a multi-layer liquid crystal panel have been known. For example, Patent Document 1 discloses an electronic device provided with a liquid crystal panel constituted by two layers, namely upper and lower layers. The electronic device in Patent Document 1 includes an upper-layer liquid crystal display circuit for driving an upper-layer liquid crystal panel and a lower-layer liquid crystal display circuit for driving a lower-layer liquid crystal panel. When the upper-layer liquid crystal display circuit displays information on the upper-layer liquid crystal panel, the lower-layer liquid crystal display circuit switches off display of all of the segments of the lower-layer liquid crystal panel, and when the lower-layer liquid crystal display circuit displays information on the lower-layer liquid crystal panel, the upper-layer liquid crystal display circuit switches all of the segments of the upper-layer liquid crystal panel to a transmissive state.

International Publication No. 00/36582 is an example of the related art.

In Patent Document 1 above, driving of each of the liquid crystal panels is independently controlled. Specifically, a display circuit that drives one liquid crystal panel in the two-layer liquid crystal panel does not drive the other liquid crystal panel. With such a configuration, there is the issue that, when display on the upper-layer liquid crystal panel cannot be switched to a transmissive state due to an abnormality in the upper-layer liquid crystal display circuit, information displayed on the lower-layer liquid crystal panel is blocked by the upper-layer liquid crystal panel, and thus the information displayed on the lower-layer liquid crystal panel becomes invisible.

SUMMARY

An aspect of the present disclosure pertains to an electro-optical apparatus that includes a first electro-optical panel that is a segment panel, a first display driver that drives the first electro-optical panel, a second electro-optical panel that is a matrix panel, and is arranged to overlap the first electro-optical panel in planar view of the first electro-optical panel, and a second display driver that displays an image on the second electro-optical panel by driving the second electro-optical panel, and the first electro-optical panel is arranged on the side from which the image is visually recognizable, and the second display driver outputs a drive voltage to a segment electrode of the first electro-optical panel.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

The following disclosure describes preferred embodiments of the present disclosure in detail. Note that the embodiments described below are not intended to unduly limit the content of the present disclosure recited in the claims, and all of the configurations described in the embodiments are not necessarily essential as solutions provided by the present disclosure.

1. Electro-Optical Apparatus

Figure 1:
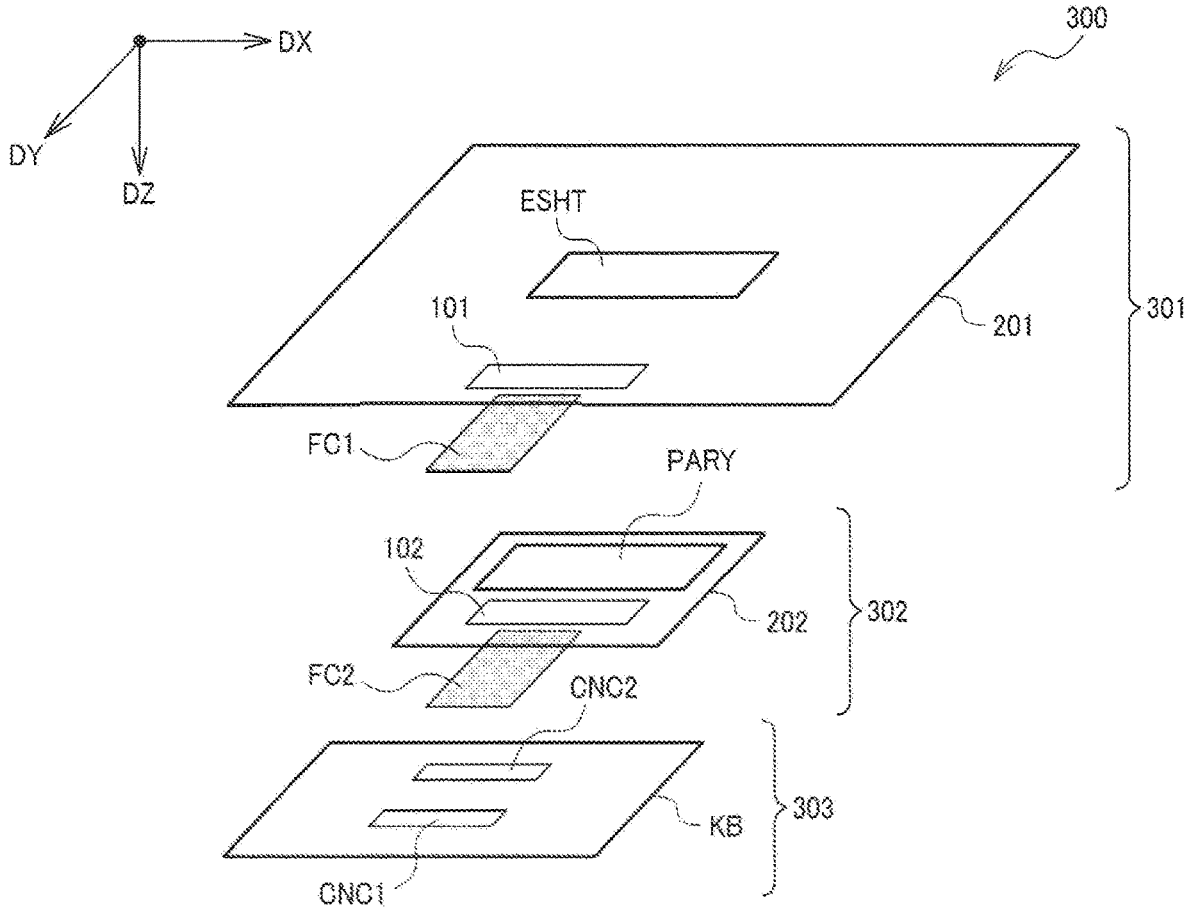
FIG. 1 shows a configuration example of an electro-optical apparatus in an embodiment of the present disclosure.

FIG. 1 shows a configuration example of an electro-optical apparatus 300 in an embodiment of the disclosure. The electro-optical apparatus 300 includes a first panel module 301, a second panel module 302, and a circuit substrate 303.

The first panel module 301 includes a first electro-optical panel 201 that is a segment liquid crystal panel, a first display driver 101 that drives the first electro-optical panel 201, and a first flexible substrate FC1.

The first electro-optical panel 201 includes a segment electrode-for-transmittance-control ESHT. The first electro-optical panel 201 can also include one or more display segment electrodes for displaying various display items.

The first display driver 101 is installed on the glass substrate of the first electro-optical panel 201. The first display driver 101 is connected to the segment electrodes by segment signal lines, and drives the segment electrodes by outputting a segment drive voltage to the segment signal lines. As will be described later with reference to FIG. 2, the segment electrode-for-transmittance-control ESHT is not connected to the first display driver 101. Note that, in FIG.

1, the first display driver 101 is illustrated as one IC, but the first display driver 101 may also be constituted by a plurality of ICs.

One edge of the first flexible substrate FC1 is connected to the glass substrate of the first electro-optical panel 201. Specifically, the first flexible substrate FC1 includes a communication signal line for transmitting display data and the like from a display controller, and a driving signal line for transmitting a drive voltage of the segment electrode-for-transmittance-control ESHT. The communication signal line is connected to one end of an interface signal line provided on the glass substrate of the first electro-optical panel 201. The other end of the interface signal line is connected to the first display driver 101. The driving signal line is connected to one end of a segment signal line-for-transmittance-control provided on the glass substrate of the first electro-optical panel 201. The other end of the segment signal line-for-transmittance-control is connected to the segment electrode-for-transmittance-control ESHT.

The second panel module 302 includes a second electro-optical panel 202 that is a matrix panel, a second display driver 102 that drives the second electro-optical panel 202, and a second flexible substrate FC2.

The second electro-optical panel 202 is an active matrix liquid crystal panel such as a TFT (Thin Film Transistor) liquid crystal panel. Alternatively, the second electro-optical panel 202 may also be a self-light-emitting display panel such as an EL (Electro Luminescence) display panel. The second electro-optical panel 202 includes a pixel array PARY in which a plurality of pixels are arranged in a matrix. Hereinafter, a region in the second electro-optical panel 202 in which the pixel array PARY is arranged is referred to as a "display region". Note that, if the pixel array PARY includes non-effective pixels that are not used for image display, a region in which effective pixels that are used for image display are arranged is referred to as a "display region".

The second display driver 102 is mounted on the glass substrate of the second electro-optical panel 202. The second display driver 102 is connected to the pixel array PARY by a signal line provided on the glass substrate of the second electro-optical panel 202, and displays an image on the pixel array PARY by outputting a data line drive signal and a scanning line drive signal to the signal line.

One edge of the second flexible substrate FC2 is connected to the glass substrate of the second electro-optical panel 202. Specifically, the second flexible substrate FC2 includes a communication signal line for transmitting display data and the like from the display controller, and a driving signal line for transmitting a drive voltage of the segment electrode-for-transmittance-control ESHT. The communication signal line is connected to one end of an interface signal line provided on the glass substrate of the second electro-optical panel 202. The driving signal line is connected to one end of a segment signal line-for-transmittance-control provided on the glass substrate of the second electro-optical panel 202. The other end of each of the interface signal line and the segment signal line-for-transmittance-control is connected to the second display driver 102.

The circuit substrate 303 includes a substrate KB, a first connector CNC1 provided on the substrate KB, and a second connector CNC2 provided on the substrate KB. The substrate KB is a printed substrate, for example.

The first connector CNC1 is connected to the other edge of the first flexible substrate FC1. The second connector CNC2 is connected to the other edge of the second flexible substrate FC2. Note that FIG. 1 illustrates a state where the connectors and the flexible substrate are not connected, but the connectors and the flexible substrate are connected in actuality. The driving signal line of the first flexible substrate FC1 and the driving signal line of the second flexible substrate FC2 are connected by a signal line on the substrate KB via the first connector CNC1 and the second connector CNC2.

As shown in FIG. 1, a direction in which the first electro-optical panel 201 is viewed in planar view is defined as DZ. Also, directions orthogonal to the direction DZ are defined as DX and DY. The direction DX and the direction DY are orthogonal to each other. In addition, hereinafter, a region in the first electro-optical panel 201 in which the segment electrode-for-transmittance-control ESHT is arranged is referred to as a "transmittance control region".

The first electro-optical panel 201 is arranged in parallel with a plane that extends in the direction DX and the direction DY. Similarly, the second electro-optical panel 202 is arranged in parallel with a plane that extends in the direction DX and the direction DY. The second electro-optical panel 202 is arranged in the direction DZ relative to the first electro-optical panel 201. In addition, as a result of the light of a display image on the second electro-optical panel 202 being transmitted through the transmittance control region in the first electro-optical panel 201, the display image on the second electro-optical panel 202 can be visually recognized by the user. In other words, the first electro-optical panel 201 is arranged on a side from which an image displayed on the second electro-optical panel 202 can be visually recognized. Note that, in FIG. 1, the first electro-optical panel 201 and the second electro-optical panel 202 are illustrated as being apart from each other, but, in actuality, the first electro-optical panel 201 and the second electro-optical panel 202 are arranged to be adjacent to each other in the direction DZ.

The segment electrode-for-transmittance-control ESHT of the first electro-optical panel 201 is rectangular, for example, and two sides of the rectangle are in parallel with the direction DX, and the two remaining sides are in parallel with the direction DY. For example, the direction DX corresponds to the horizontal scanning direction of the pixel array PARY, and the direction DY corresponds to the vertical scanning direction of the pixel array PARY. The segment electrode-for-transmittance-control ESHT overlaps the display region of the second electro-optical panel 202, when viewed in planar view. For example, the size of the segment electrode-for-transmittance-control ESHT is the same as the size of the display region of the pixel array PARY, and the first electro-optical panel 201 and the second electro-optical panel 202 are arranged such that the segment electrode-for-transmittance-control ESHT and the display region match when viewed in planar view in the direction DZ.

Figure 2:
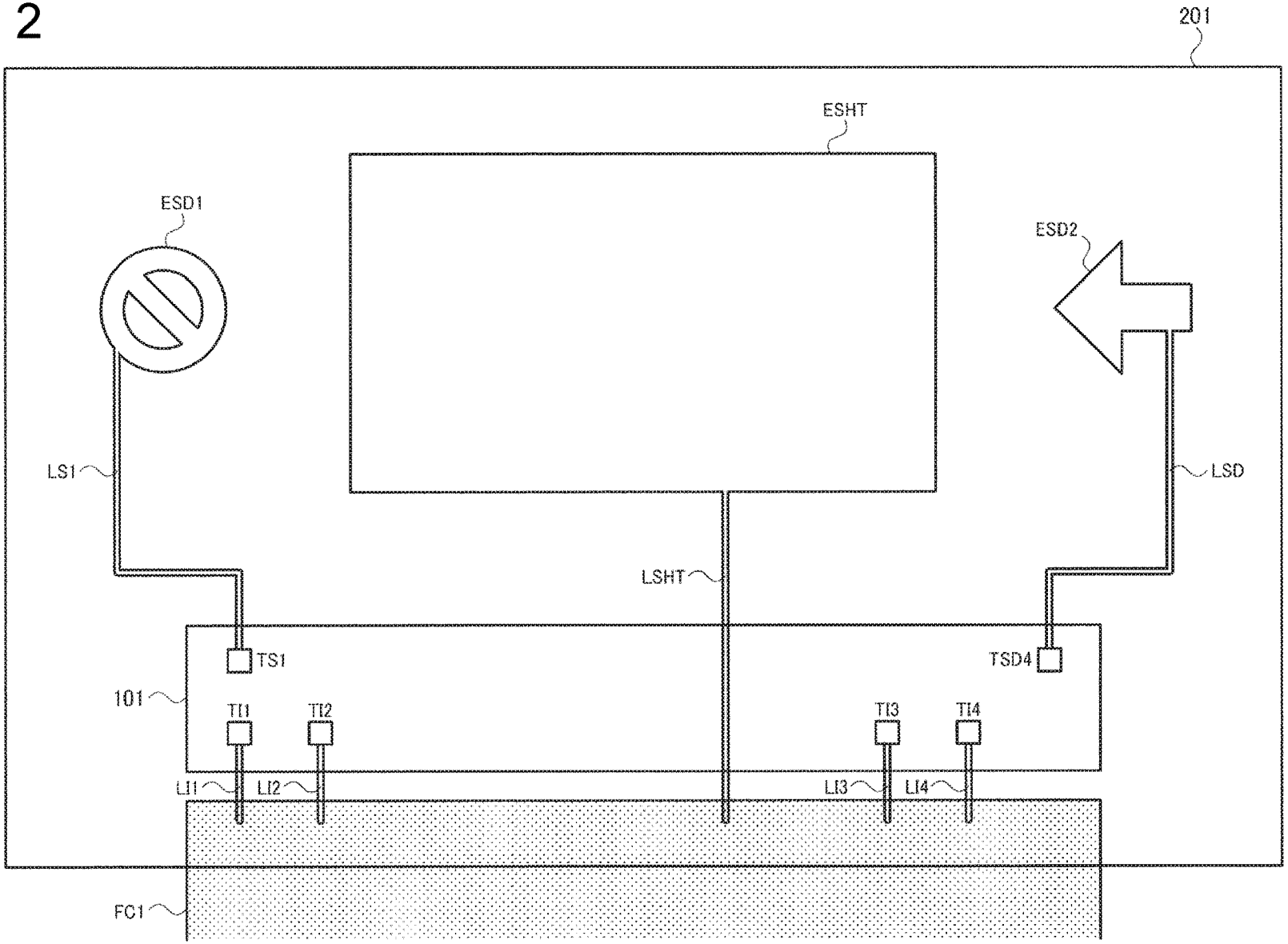
FIG. 2 shows a first example of a detailed configuration of a first electro-optical panel.

FIG. 2 shows a first example of a detailed configuration of the first electro-optical panel 201. Note that the shape and arrangement of the segment electrodes shown in FIG. 2 are exemplary, and the shape and arrangement of the segment electrodes are not limited to those in FIG. 2. In addition, in FIG. 2, illustration of a common electrode and a common signal line connected to the common electrode is omitted.

As shown in FIG. 2, the first electro-optical panel 201 includes segment electrodes-for-display ESD1 and ESD2, the segment electrode-for-transmittance-control ESHT, segment signal lines LS1 and LS2, a segment signal line-for-transmittance-control LSHT, and interface signal lines LI1 to LI4 The segment signal lines LS1 and LS2 are respectively connected to the segment electrode-for-display ESD1 and ESD2. The segment signal line-for-transmittance-control LSHT is connected to the segment electrode-for-transmittance-control ESHT.

The segment electrodes and segment signal lines are formed of a transparent conductive film provided on the glass substrate. The transparent conductive film is made of ITO (Indium Tin Oxide), for example. A portion of this transparent conductive film that opposes the common electrode such that the portion and the common electrode sandwich the liquid crystal is a segment electrode, and a portion for supplying a segment drive signal to the segment electrode is a segment signal line. For example, the segment electrode-for-display ESD1 and the segment signal line LS1 are formed of the same transparent conductive film. A portion of this film that opposes the common electrode is the segment electrode-for-display ESD1. Similarly, the interface signal line is also a transparent conductive film provided on the glass substrate.

The first display driver 101 includes segment terminals TS1 and TS2 and interface terminals TI1 to TI4. The segment terminals TS1 and TS2 are connected to the segment signal lines LS1 and LS2, respectively. Each of the interface terminals TI1 to TI4 is connected to one end of the corresponding one of the interface signal lines LI1 to LI4. The first flexible substrate FC1 is connected to the other end of each of the interface signal lines LI1 to LI4. Also, the segment signal line-for-transmittance-control LSHT is connected to the first flexible substrate FC1.

The second display driver 102 in FIG. 1 outputs a drive voltage to the segment signal line-for-transmittance-control LSHT, via the driving signal lines of the first flexible substrate FC1 and the second flexible substrate FC2 and a signal line of the circuit substrate 303. Accordingly, a drive voltage is applied to the segment electrode-for-transmittance-control ESHT, and the light transmissivity of the liquid crystal in the transmittance control region in which the segment electrode-for-transmittance-control ESHT is arranged is controlled. For example, the second display driver 102 switches between two states, namely a transmissive state and a non-transmissive state. Specifically, the second display driver 102 outputs a first drive voltage for switching the transmittance control region to a transmissive state or a second drive voltage for switching the transmittance control region to a non-transmissive state, to the segment electrode-for-transmittance-control ESHT. Alternatively, the second display driver 102 may also perform gradation control for controlling the transmissivity to a plurality of tone values. In other words, the second display driver 102 may also output one of a plurality of drive voltages for performing gradation control of transmissivity, to the segment electrode-for-transmittance-control ESHT.

Note that the transmissive state of the transmittance control region is a state where the liquid crystal of the transmittance control region transmits light, and a state where a display image on the second electro-optical panel 202 can be thereby visually recognized. However, the transmissive state does not only refer to a case where the light transmissivity is 100%, and as long as a display image on the second electro-optical panel 202 is visually recognizable, the light transmissivity may take any value. Also, the non-transmissive state of the transmittance control region is a state where the liquid crystal of the transmittance control region blocks light, and a state where a display image on the second electro-optical panel 202 is thereby not visually recognizable. However, the non-transmissive state does not only refer to a case where the light transmissivity is 0%, and the light transmissivity may be within a certain range depending on the visual recognizability of a display image.

Here, for example, consider a case where the first display driver 101 in FIGS. 1 and 2 drives the segment electrode-for-transmittance-control ESHT of the first electro-optical panel 201. In this case, there is a risk that, if an abnormality occurs in the first display driver 101, the transmittance control region is switched to a non-transmissive state, and a display image on the second electro-optical panel 202 cannot be visually recognized. For example, a normally-black segment liquid crystal panel is adopted in an on-board cluster panel in order to create a sense of luxury. It is envisioned that, if a state occurs in which the first display driver 101 cannot be driven, a transmittance control region provided in the normally-black segment liquid crystal panel is switched to a non-transmissive state.

In this regard, in this embodiment, the second display driver 102, which drives the second electro-optical panel 202 that is a matrix panel, outputs a drive voltage to the segment electrode-for-transmittance-control ESHT of the first electro-optical panel 201, and thereby the light transmissivity of the liquid crystal in the transmittance control region is controlled. Here, the transmissivity is the transmissivity when a display image on the second electro-optical panel 202 is transmitted through the first electro-optical panel 201. With such a configuration, even if an abnormality occurs in the first display driver 101 that drives the first electro-optical panel 201, the second display driver 102 drives the segment electrode-for-transmittance-control ESHT, and thus a display image on the second electro-optical panel 202 is transmitted through the segment electrode-for-transmittance-control ESHT, so as to be visually recognizable.

2. Display Control System

Figure 3:
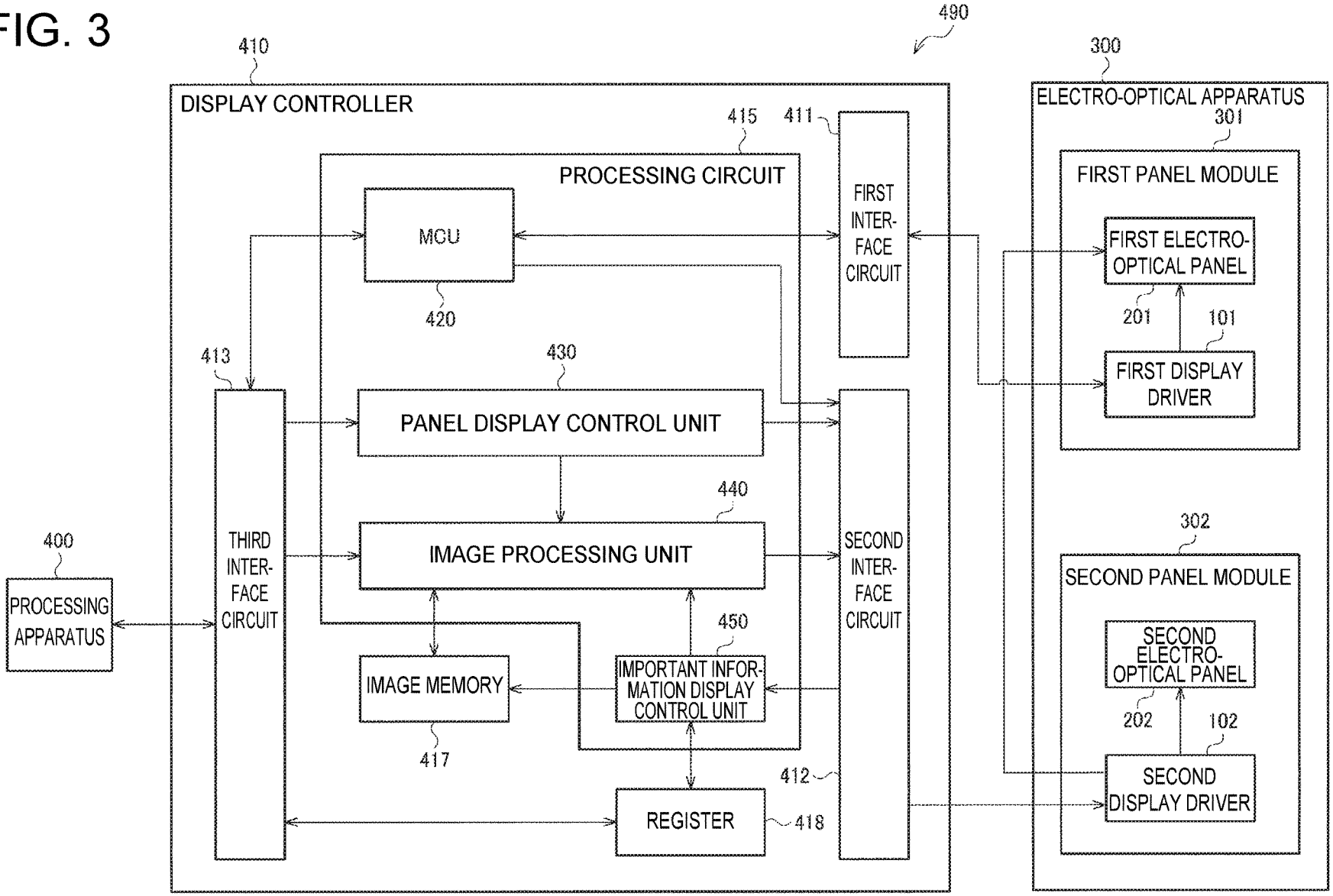
FIG. 3 shows a configuration example of a display control system.

FIG. 3 shows a configuration example of a display control system 490 that includes the electro-optical apparatus 300. The display control system 490 includes a processing apparatus 400, a display controller 410, and the electro-optical apparatus 300.

The processing apparatus 400 is a host apparatus of the display controller 410, and is a processor, for example. The processor is a CPU, a microcomputer, or the like. Note that the processing apparatus 400 may be a circuit apparatus constituted by a plurality of circuit components. For example, in an on-board electronic device, the processing apparatus 400 may also be an ECU (Electronic Control Unit).

The display controller 410 controls display on the electro-optical apparatus 300 by outputting, to the electro-optical apparatus 300, voltage setting data, display data, and a timing control signal. The voltage setting data is data corresponding to display content on the first electro-optical panel 201 that is a segment panel. The display data is data corresponding to display content of the second electro-optical display content panel 202 that is a matrix panel. The timing control signal is a control signal that is output to the second display driver 102, and is a pixel clock signal, a horizontal synchronization signal, a vertical synchronization signal, or the like. The display controller 410 includes first to third interface circuits 411 to 413, a processing circuit 415, an image memory 417, and a register 418. The display controller 410 is an integrated circuit apparatus, for example.

The third interface circuit 413 performs inter-circuit communication between the processing apparatus 400 and the display controller 410. Specifically, the third interface circuit 413 receives voltage setting data and display data from the processing apparatus 400, and outputs the voltage setting data and display data to the processing circuit 415. The third interface circuit 413 also receives various pieces of operation setting information from the processing apparatus 400, and writes the operation setting information to the register 418. For example, the third interface circuit 413 receives setting information for designating important information, from the processing apparatus 400, The important information is information for designating which portion of content displayed on the first electro-optical panel 201 is to be displayed on the second electro-optical panel 202, when an abnormality is detected in the first panel module 301.

The processing circuit 415 is a logic circuit, and performs processing of voltage setting data, processing of display data, processing for outputting a timing control signal, and the like. The processing circuit 415 includes an MCU 420 (Micro Control Unit), a panel display control unit 430, an image processing unit 440, and an important information display control unit 450.

The MCU 420 outputs, to the first interface circuit 411, voltage setting data for setting a drive voltage to be supplied to the segments of the first electro-optical panel 201, based on voltage setting data from the third interface circuit 413. The MCU 420 also outputs, to the second interface circuit 412, voltage setting data for setting a drive voltage to be supplied to the segment electrode for transmittance control, based on voltage setting data from the third interface circuit 413. For example, the MCU 420 converts the data format of voltage setting data into a data format that can be received by the first display driver 101 and the second display driver 102.

The first interface circuit 411 outputs voltage setting data from the MCU 420 to the first display driver 101. For example, a serial interface method such as an I2C (Inter Integrated Circuit) method or an SPI (Serial Peripheral Interface) method can be adopted as the communication method of the first interface circuit 411. Alternatively, a parallel interface method may also be adopted as the communication method. The first interface circuit 411 can include an input/output buffer circuit and a control circuit for realizing these communication methods.

The panel display control unit 430 outputs timing control signals such as a pixel clock signal, a horizontal synchronization signal, and a vertical synchronization signal, to the second interface circuit 412. The image processing unit 440 performs image processing on display data from the third interface circuit 413, and outputs the processed display data to the second interface circuit 412. For example, the image processing unit 440 converts the data format of display data into a data format that can be received by the second display driver 102. Alternatively, the image processing unit 440 may also perform image processing such as tone conversion processing on display data. The image processing unit 440 also performs processing for superimposing display content of the first electro-optical panel 201 on a display image of the second electro-optical panel 202, based on an instruction from the important information display control unit 450.

When the first display driver 101 detects a driving abnormality, the important information display control unit 450 outputs, to the image processing unit 440, an instruction to display the display content of the first electro-optical panel 201 on the second electro-optical panel 202. Specifically, the first interface circuit 411 receives an error detection signal from the first display driver 101. The error detection signal is a signal indicating that the first display driver 101 has detected a driving abnormality. The received error detection signal is stored in the register 418 via the MCU 420 and the third interface circuit 413. The important information display control unit 450 determines, based on the error detection signal stored in the register 418, that the first display driver 101 has detected a driving abnormality.

The image memory 417 stores image data for displaying important information. The image data for displaying important information is image data for displaying, on the second electro-optical panel 202, an image displayed by a segment electrode-for-display provided in the first electro-optical panel 201. The image memory 417 is, for example, a RAM, a nonvolatile memory, or the like. A plurality of display contents are displayed on the first electro-optical panel 201, but image data corresponding to each of the display contents is stored in the image memory 417. The important information display control unit 450 provides, to the image processing unit 440 and the image memory 417, an instruction regarding which one of a plurality of display contents is to be displayed on the second electro-optical panel 202, based on setting information stored in the register 418. The image memory 417 outputs image data corresponding to the instructed display content, to the image processing unit 440. The image processing unit 440 performs superimposition processing based on the image data input from the image memory 417, and outputs the processed display data to the second interface circuit 412.

The second interface circuit 412 outputs a timing control signal from the panel display control unit 430 and display data from the image processing unit 440, to the second display driver 102. The second interface circuit 412 also outputs voltage setting data from the MCU 420 to the second display driver 102. The above-mentioned serial interface method, parallel interface method, or the like can be adopted as a communication method of the second interface circuit 412. The second interface circuit 412 can include an input/output buffer circuit and a control circuit for realizing these communication methods.

According to the embodiment described with reference to FIG. 3, since the display controller 410 includes the first interface circuit 411 and the second interface circuit 412, the display controller 410 can perform display control of the first display driver 101 and the second display driver 102.

Accordingly, the display controller 410 can control the electro-optical apparatus 300 in which the first electro-optical panel 201 that is a segment panel and the second electro-optical panel 202 that is a matrix panel are combined.

In addition, according to this embodiment, when a display abnormality in the first electro-optical panel 201 is detected, the second display driver 102 displays, on the second electro-optical panel 202, an image corresponding to display items of the first electro-optical panel 201. Specifically, as described above, when a display abnormality in the first electro-optical panel 201 is detected, the display controller 410 outputs, to the second display driver 102, display data that includes display items of the first electro-optical panel 201, and the second display driver 102 displays an image on the second electro-optical panel 202 based on the display data.

With such a configuration, even if a display abnormality occurs in the first electro-optical panel 201 due to an abnormality in the first display driver 101 or the like, an image corresponding to display items of the first electro-optical panel 201 is displayed on the second electro-optical panel 202. As will be described later with reference to FIG. 4, for example, in an on-board cluster panel, display items of the first electro-optical panel 201 are icons or meter displays, and the like. According to this embodiment, when these pieces of information are not displayed on the first electro-optical panel 201, the information can be presented to the user by being displayed on the second electro-optical panel 202. Since a drive voltage has been applied from the second display driver 102 to the segment electrode-for-transmittance-control ESHT, even if there is an abnormality in the first display driver 101, icons and the like displayed on the second electro-optical panel 202 are visually recognizable through the segment electrode-for-transmittance-control ESHT.

Figure 4:
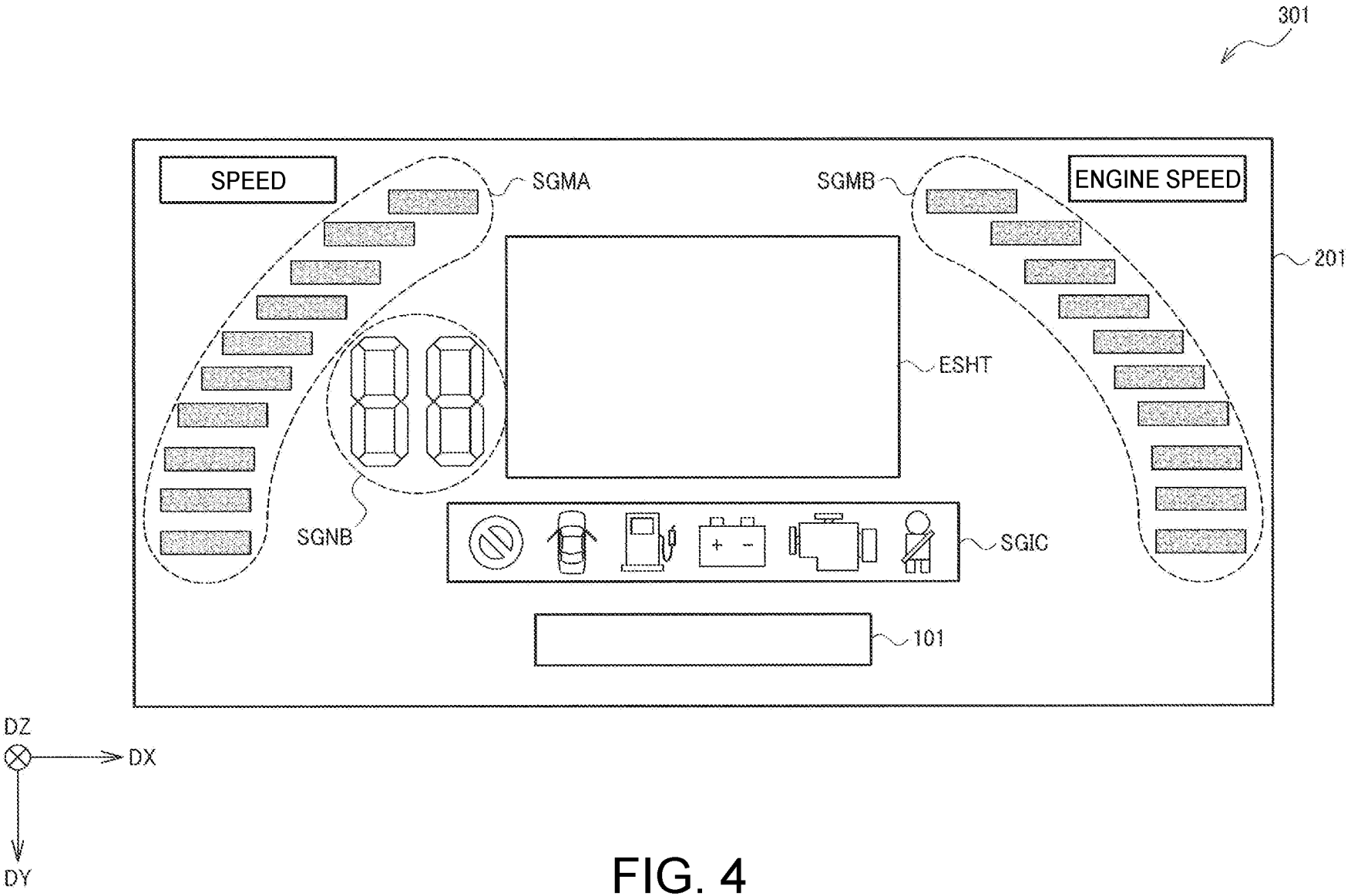
FIG. 4 is an example of a detailed configuration of the first electro-optical panel when the electro-optical apparatus is applied to an on-board cluster panel.

FIG. 4 shows an example of a detailed configuration of the first electro-optical panel 201 when the electro-optical apparatus 300 is applied to an on-board cluster panel, Note that, in FIG. 4, illustration of segment signal lines and a flexible substrate is omitted. In addition, dotted lines shown in FIG. 4 are provided for adding reference signs, and are not displayed in actuality.

The first electro-optical panel 201 includes a segment electrode group SGMA for displaying a speedometer, a segment electrode group SGMB for displaying an engine speedometer, a segment electrode group SGNB for displaying numerals, a segment electrode group SGIC for displaying alarm lamps, and the segment electrode-for-transmittance-control ESHT.

The first display driver 101 displays meters, numerals, and alarm lamps by outputting a drive voltage to the segment electrodes in the above segment electrode groups SGMB, SGNB, and SGIC. As described above, a drive voltage is applied from the second display driver 102 to the segment electrode-for-transmittance-control ESHT.

When a display abnormality occurs in the first electro-optical panel 201, the second display driver 102 displays, for example, an alarm lamp on the second electro-optical panel 202. The alarm lamp is represented by an icon corresponding to its alarm content. Note that not only an alarm lamp but also various icons may be provided on the first electro-optical panel 201. When a display abnormality occurs in the first electro-optical panel 201, the second display driver 102 may display these icons on the second electro-optical panel 202.

With such a configuration, when a display abnormality occurs in the first electro-optical panel 201, an icon considered to be particularly important such as an alarm lamp, from among the display items displayed on the first electro-optical panel 201, can be presented to the user by displaying it on the second electro-optical panel 202.

Alternatively, when a display abnormality occurs in the first electro-optical panel 201, the second display driver 102 may also display alarm lamps, meters, or numerals on the second electro-optical panel 202. The second display driver 102 can also display two or more display items out of the alarm lamps, meters, and numerals, on the second electro-optical panel 202.

With such a configuration, when a display abnormality occurs in the first electro-optical panel 201, any display item out of the alarm lamps, meters, and numerals can be presented to the user by displaying it on the second electro-optical panel 202.

3. Second Display Driver

HG. 5 shows an example of a detailed configuration of the second display driver 102. Note that, here, as an example, a case will be described in which the second display driver 102 performs gradation control of the segment electrode-for-transmittance-control ESHT, but the second display driver 102 may also control the segment electrode-for-transmittance-control ESHT between two states, namely a transmissive state and a non-transmissive state.

The second display driver 102 includes interface circuits 171 and 172, a drive voltage generation circuit 173, a control circuit 174, a first drive circuit 181, a second drive circuit 182, and drive terminal groups TGRA to TGRC. Note that TGRC is set as a first drive terminal group, and TGRA and TGRB are combined into a second drive terminal group. The first drive circuit 181 includes a tone voltage generation circuit 175 and an output circuit 179. The second drive circuit 182 includes a data line driver 176 and a scanning line driver 178.

The interface circuit 171 receives voltage setting data from the display controller 410. The interface circuit 171 also receives, from the display controller 410, setting data for setting the voltage value of a power supply voltage that is output by the drive voltage generation circuit 173. The interface circuit 172 receives display data and a timing control signal from the display controller 410.

The drive voltage generation circuit 173 outputs a power supply voltage corresponding to setting data received by the interface circuit 171, to the data line driver 176 and the scanning line driver 178. The drive voltage generation circuit 173 includes a DC/DC converter that performs voltage conversion of an external power supply voltage supplied from the outside of the second display driver 102, and the like.

The control circuit 174 outputs, to the data line driver 176, display data received by the interface circuit 172, at a timing determined by a timing control signal. The control circuit 174 also outputs a timing control signal such as a horizontal synchronization signal to the scanning line driver 178.

TGRA and TGRB in the second drive terminal group are connected to the second electro-optical panel 202, The second drive circuit 182 drives the second electro-optical panel 202 via the second drive terminal group.

Specifically, the drive terminal group TGRA is connected to a data line group of the second electro-optical panel 202, The data line driver 176 outputs a data voltage corresponding to display data from the control circuit 174, to the data line group of the second electro-optical panel 202 via the drive terminal group TGRA. The data line driver 176 includes a D/A conversion circuit that performs D/A conversion on display data, and an amplifier circuit that outputs a data voltage based on an output voltage of the D/A conversion circuit.

The drive terminal group TGRB is connected to a scanning line group of the second electro-optical panel 202, The scanning line driver 178 outputs a scanning line selection signal for sequentially selecting a scanning line included in the scanning line group, to the scanning line group of the second electro-optical panel 202 via the drive terminal group TGRB. The scanning line driver 178 includes a logic circuit that generates a scanning line selection signal based on a horizontal synchronization signal, and a buffer circuit that buffers a scanning line selection signal from the logic circuit, and outputs it to the drive terminal group TGRB.

TGRC defined as the first drive terminal group is connected to the first electro-optical panel 201. The first drive circuit 181 drives the first electro-optical panel 201 via the first drive terminal group.

Specifically, the drive terminal group TGRC is connected to the segment signal line for transmittance control and the common signal line of the first electro-optical panel 201. In the configuration in FIG. 1, as an example, the first drive terminal group is connected to a signal line group provided on the glass substrate of the second electro-optical panel 202, and the signal line group is connected to the segment signal line group for transmittance control and the common signal line of the first electro-optical panel 201 via the second flexible substrate FC2, the circuit substrate 303, and the first flexible substrate FC1. The second drive circuit 182 controls the light transmissivity of the liquid crystal in the transmittance control region in which the segment electrode for transmittance control is provided, by outputting a drive voltage to the segment electrode for transmittance control and the common electrode via the drive terminal group TGRC. Note that the drive terminal group TGRC may also include a terminal for outputting a drive voltage to the segment electrode-for-display.

The tone voltage generation circuit 175 outputs a tone voltage corresponding to voltage setting data from the interface circuit 171. The output circuit 179 outputs a drive voltage to the segment electrode and the common electrode using the tone voltage.

Figure 5:
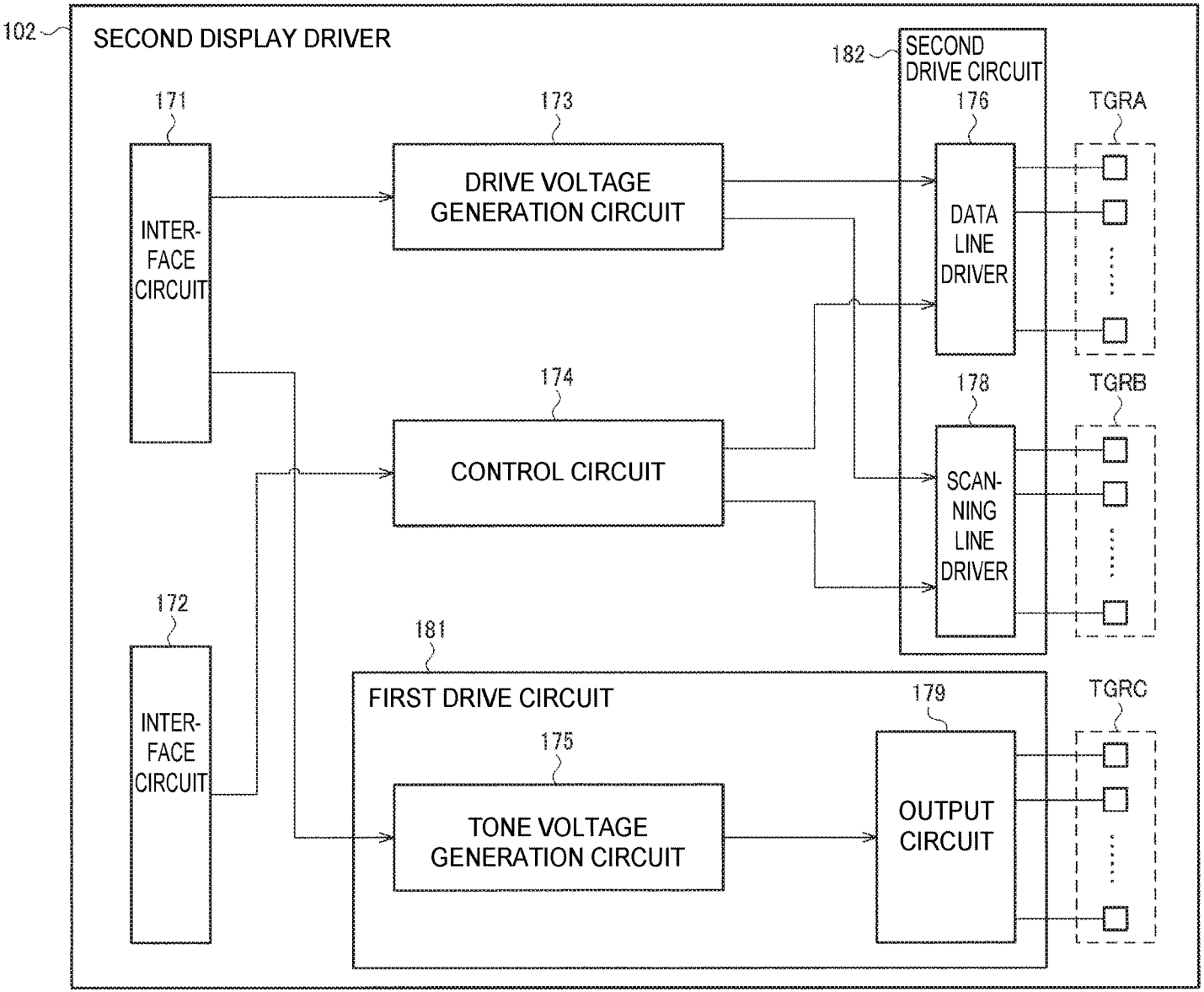
FIG. 5 shows an example of a detailed configuration of a second display driver.

According to the embodiment described with reference to FIG. 5, the second display driver 102 includes the first drive circuit 181 that drives the first electro-optical panel 201 via the first drive terminal group, and the second drive circuit 182 that drives the second electro-optical panel 202 via the second drive terminal group. Accordingly, the second display driver 102 that drives the second electro-optical panel 202 that is a matrix panel can output a drive voltage to the segment electrode for transmittance control provided in the first electro-optical panel 201 that is a segment panel.

Figure 6:
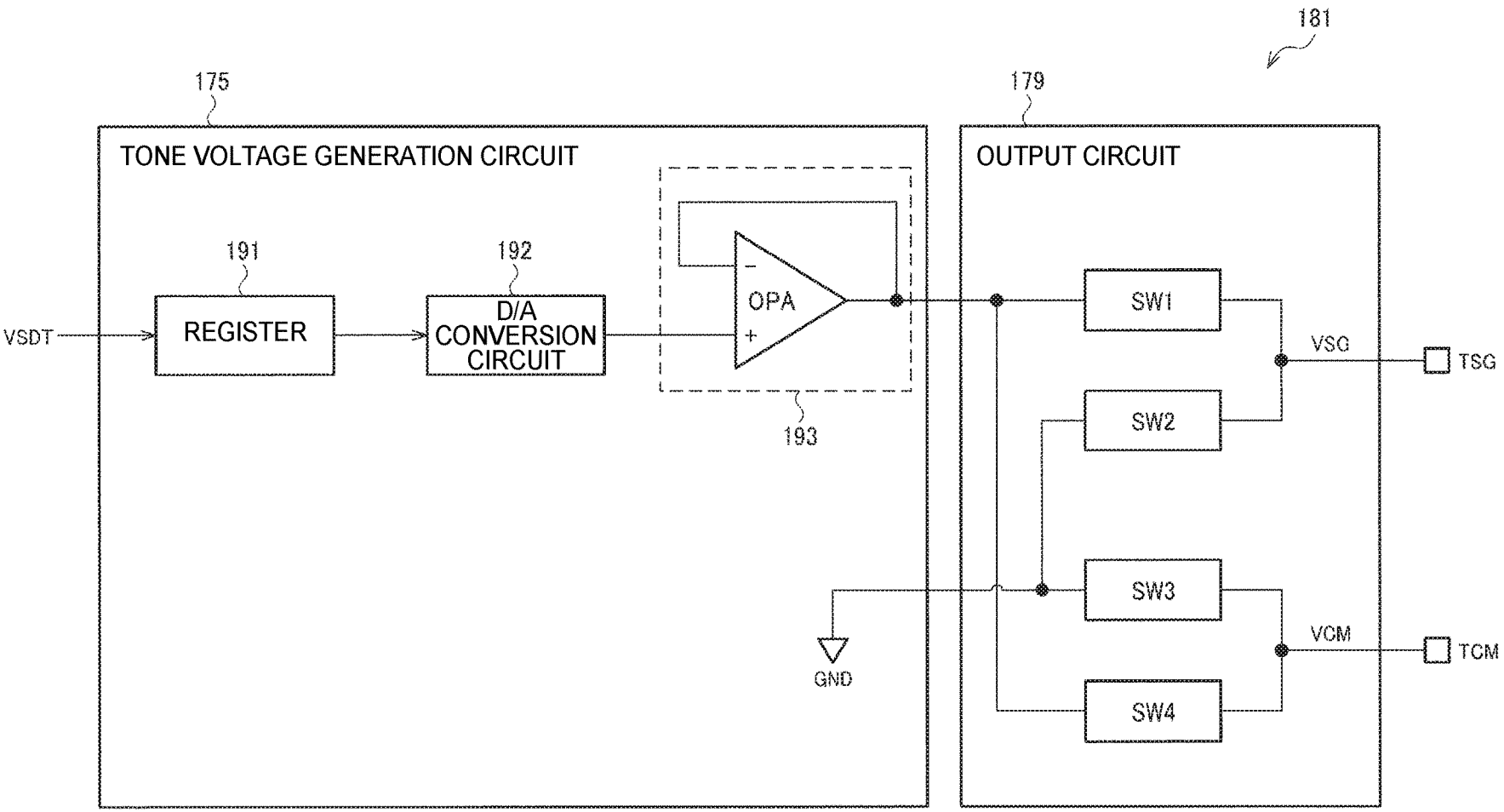
FIG. 6 shows an example of a detailed configuration of a first drive circuit.

FIG. 6 shows an example of a detailed configuration of the first drive circuit 181. As shown in FIG. 6, the tone voltage generation circuit 175 includes a register 191, a D/A conversion circuit 192, and a voltage follower circuit 193. The output circuit 179 includes switches SW1 to SW4.

Voltage setting data is written in the register 191 from the interface circuit 171. The voltage setting data is data that enables designation of three or more tone values, and is data that enables designation of halftones in addition to the transmissive state and non-transmissive state. The D/A conversion circuit 192 converts voltage setting data written in the register 191 into a voltage of a tone value designated by the voltage setting data. The voltage follower circuit 193 includes an operation amplifier OPA connected thereto through voltage follower connection. The voltage follower circuit 193 outputs a tone voltage by buffering an output voltage of the D/A conversion circuit 192.

The switches SW1 to SW4 are analog switches, and are each constituted by a transistor, for example. One end of each of the switches SW1 and SW2 is connected to a terminal TSG. The other end of the switch SW1 is connected to the output node of the voltage follower circuit 193, and the other end of the switch SW2 is connected to a ground node. One end of each of the switches SW3 and SW4 is connected to a terminal TCM. The other end of the switch SW3 is connected to a ground node, and the other end of the switch SW4 is connected to the output node of the voltage follower circuit 193. The terminals TSG and TCM are included in the drive terminal group TGRC. The terminal TSG is a terminal connected to the segment electrode for transmittance control, and the terminal TCM is a terminal connected to the common electrode.

Figure 7:
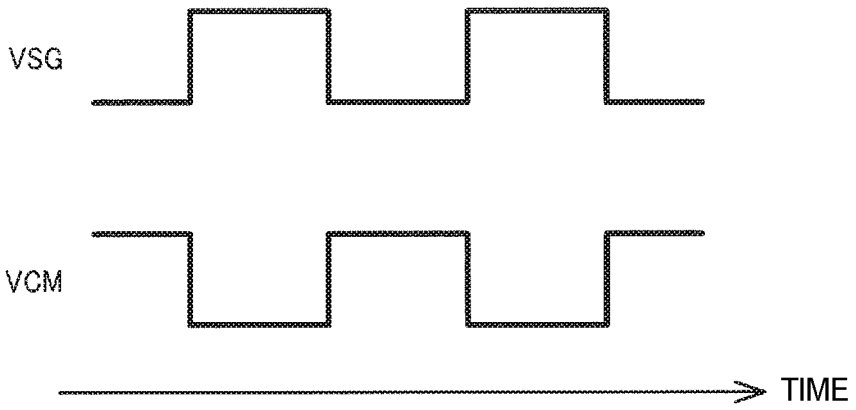
FIG. 7 is a waveform chart illustrating operations of switches.

FIG. 7 shows a waveform chart illustrating operations of the switches SW1 to SW4. Note that, hereinafter, a drive voltage that is output to the segment electrode is referred to as a "segment drive voltage", and a drive voltage that is output to the common electrode is referred to as a "common drive voltage". A segment drive voltage that is output to the terminal TSG by the output circuit 179 is denoted as VSG, and a common drive voltage that is output to the terminal TCM by the output circuit 179 is denoted as VCM.

In a first state, the switches SW1 and SW3 are switched on, and the switches SW2 and SW4 are switched off. Accordingly, the segment drive voltage VSG changes to a tone voltage, and the common drive voltage VCM changes to a ground voltage GND. In a second state, the switches SW2 and SW4 are switched on, and the switches SW1 and SW3 are switched off. Accordingly, the segment drive voltage VSG changes to the ground voltage GND, and the common drive voltage VCM changes to a tone voltage. As shown in FIG. 7, the first state and the second state are periodically repeated. |VSG-VCM| represents a tone voltage, and thus a tone voltage is applied to the liquid crystal between the segment electrode for transmittance control and the common electrode. As described above, as a result of the tone voltage taking a plurality of tone values, gradation control can be performed.

According to the embodiment above, the second display driver 102 can perform gradation control of the transmissivity of the liquid crystal in the transmittance control region in which the segment electrode for transmittance control is arranged. Accordingly, an image displayed on the second electro-optical panel 202 that is a matrix panel is transmitted through the first electro-optical panel 201 at a transmissivity acquired through the gradation control. For example, in an on-board cluster panel and the like, a display image on the second electro-optical panel 202 can be presented to the user with appropriate brightness, by controlling the transmissivity according to the brightness in an environment.

4. Configuration Example When Performing Abnormality Detection

A configuration example of the first electro-optical panel 201 and the first display driver 101 when performing processing for detecting a display abnormality in the first electro-optical panel 201 will be described below.

Figure 8:
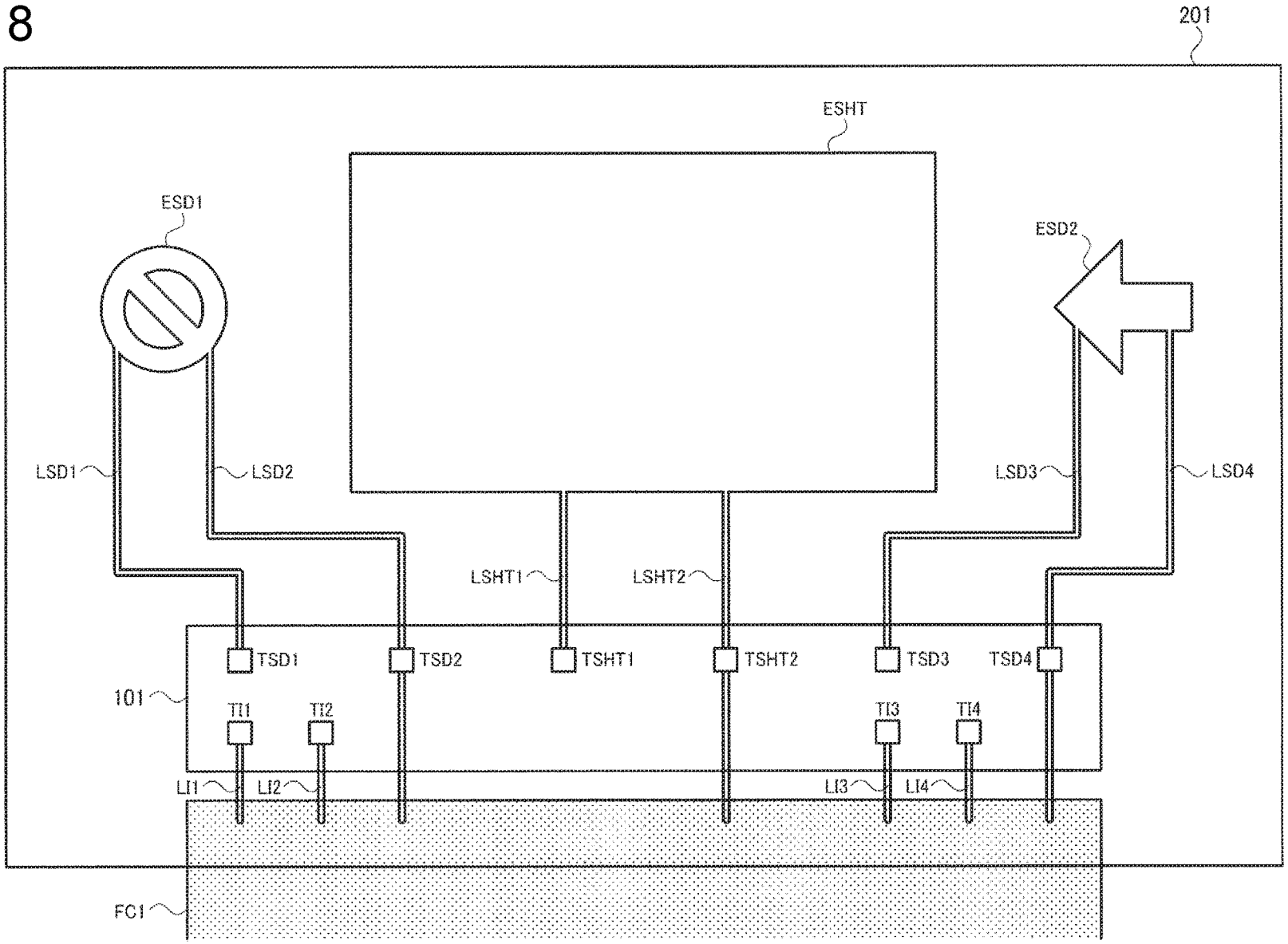
FIG. 8 shows a second example of a detailed configuration of the first electro-optical panel.

FIG. 8 shows a second example of a detailed configuration of the first electro-optical panel 201. In FIG. 8, illustration of a common electrode and a common signal line connected to the common electrode is omitted Note that the same reference numerals are assigned to the same constituent elements as those described with reference to FIG. 2, and description of such constituent elements is omitted as appropriate.

The first electro-optical panel 201 includes the segment electrodes-for-display ESD1 and ESD2, the segment electrode-for-transmittance-control ESHT, segment signal lines LSD1 to LSD4, segment signal lines-for-transmittance-control LSHT1 and LSHT2, and the interface signal lines LI1 to LI4. The segment signal lines LSD1 and LSD2 are connected to the segment electrode-for-display ESD1, and the segment signal lines LSD3 and LSD4 are connected to the segment electrode-for-display ESD2. The segment signal lines-for-transmittance-control LSHT1 and LSHT2 are connected to the segment electrode-for-transmittance-control ESHT.

The first display driver 101 includes segment terminals TSD1 to TSD4, TSHT1, and TSHT2, and the interface terminals TI1 to TI4. The segment terminals TSD1 to TSD4 are respectively connected to the segment signal lines LSD1 to LSD4. The segment terminals TSHT1 and TSHT2 are respectively connected to the segment signal lines-for-transmittance-control LSHT1 and LSHT2. The segment signal lines LSD2 and LSD4 and the segment signal line-for-transmittance-control LSHT2 are connected to the first flexible substrate FC1. The segment signal lines LSD2 and LSD4 and the segment signal line-for-transmittance-control LSHT2 are also connected to the second display driver 102 via the first flexible substrate FC1, the circuit substrate 303, and the second flexible substrate FC2.

The second display driver 102 can output a drive voltage to the segment signal lines LSD2 and LSD4 and the segment signal line-for-transmittance-control LSHT2 via the first flexible substrate FC1, the circuit substrate 303, and the second flexible substrate FC2. Accordingly, the second display driver 102 can drive the segment electrodes-for-display ESD1 and ESD2 and the segment signal line-for-transmittance-control LSHT. Specifically, when the first display driver 101 detects a display abnormality in the first electro-optical panel 201, the second display driver 102 drives the segment electrodes-for-display ESD1 and ESD2 and the segment signal line-for-transmittance-control LSHT.

Figure 9:
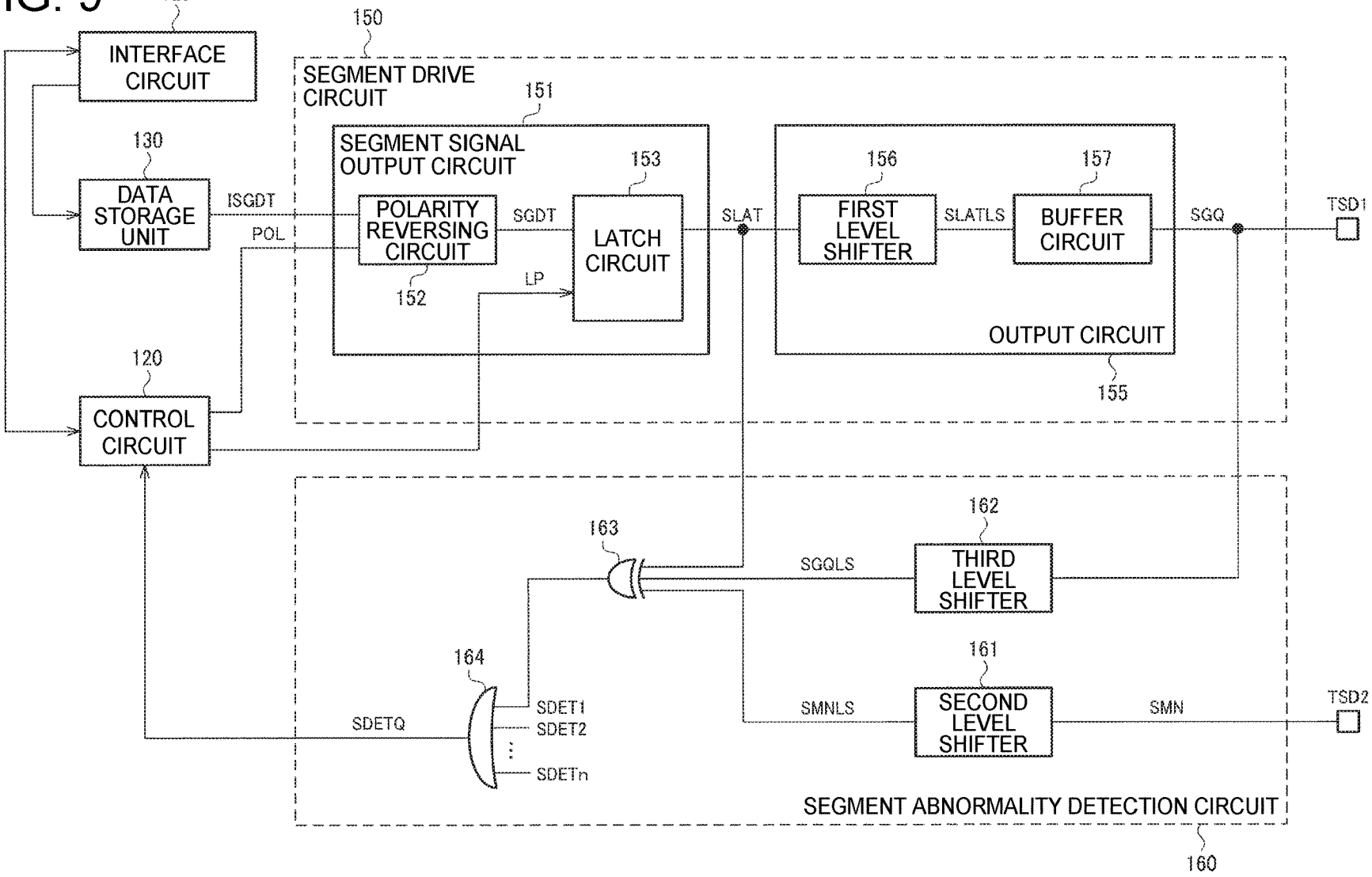
FIG. 9 shows an example of a detailed configuration of a first display driver.

FIG. 9 is an example of a detailed configuration of the first display driver 101. The first display driver 101 includes a control circuit 120, an interface circuit 125, a data storage unit 130, a segment drive circuit 150, and a segment abnormality detection circuit 160. Note that a segment drive circuit and a segment abnormality detection circuit connected to the segment terminals TSD1 and TSD2 in FIG. 8 will be described below as an example, but a similar segment drive circuit and segment abnormality detection circuit are provided for the segment terminals TSD3 and TSD4 and the segment terminals TSHT1 and TSHT2.

The interface circuit 125 receives voltage setting data from the display controller 410. Also, the interface circuit 125 outputs an error detection signal to the display controller 410.

The data storage unit 130 stores voltage setting data received by the interface circuit 125. The data storage unit 130 is a RAM or register, for example.

The segment drive circuit 150 includes a segment signal output circuit 151 that outputs a segment signal SLAT based on voltage setting data ISGDT, and an output circuit 155 that outputs a segment drive signal SGQ based on the segment signal SLAT.

Specifically, the segment signal output circuit 151 includes a polarity reversing circuit 152 and a latch circuit 153. When a voltage is applied to a liquid crystal cell corresponding to the segment electrode-for-display ESD1, the voltage setting data ISGDT is at a high level, and when no voltage is applied to the liquid crystal cell, the voltage setting data ISGDT is at a low level. The polarity reversing circuit 152 performs processing for reversing the polarity of the voltage setting data ISGDT, based on a polarity signal POL input from the control circuit 120. Specifically, the polarity reversing circuit 152 outputs an output signal SGDT at the same logic level as the voltage setting data ISGDT, in a positive frame, and outputs the output signal SGDT at a logic level acquired by reversing the logic level of the voltage setting data ISGDT, in a negative frame. The latch circuit 153 latches the output signal SGDT using a latch pulse LP input from the control circuit 120, and outputs it as the segment signal SLAT.

The output circuit 155 includes a first level shifter 156 and a buffer circuit 157.

The first level shifter 156 outputs an output signal SLATLS by level-shifting the segment signal SLAT. The control circuit 120, the data storage unit 130, and the segment signal output circuit 151 operate using a first power supply voltage, and the buffer circuit 157 operates using a second power supply voltage that is different from the first power supply voltage. Accordingly, the first level shifter 156 level-shifts the signal level of the first power supply voltage to the signal level of the second power supply voltage. For example, the second power supply voltage is higher than the first power supply voltage.

The buffer circuit 157 outputs the segment drive signal SGQ based on the output signal SLATLS of the first level shifter 156. In other words, the buffer circuit 157 outputs the segment drive signal SGQ by buffering the output signal SLATLS. If there is no abnormality in the circuit, the logic levels of the segment signal SLAT and the segment drive signal SGQ are the same.

The segment abnormality detection circuit 160 performs processing for detecting a driving abnormality in the segment electrode-for-display ESD1, by comparing a segment monitor signal SMN, the segment signal SLAT, and the segment drive signal SGQ. The segment abnormality detection circuit 160 includes a second level shifter 161, a third level shifter 162, an exclusive OR circuit 163, and an OR circuit 164.

The second level shifter 161 level-shifts the segment monitor signal SMN, and outputs a level-shifted segment monitor signal SMNLS to the exclusive OR circuit 163. The third level shifter 162 level-shifts the segment drive signal SGQ, and outputs a level-shifted segment drive signal SGQLS to the exclusive OR circuit 163. The exclusive OR circuit 163 and the OR circuit 164 operate using the first power supply voltage. Accordingly, the second level shifter 161 and the third level shifter 162 level-shift the signal level of the second power supply voltage to the signal level of the first power supply voltage.

The exclusive OR circuit 163 obtains the exclusive OR of the level-shifted segment monitor signal SMNLS, the segment signal SLAT, and the level-shifted segment drive signal SGQLS, and outputs a resulting detection signal SDET1. If the logic levels of SMNLS, SLAT, and SGQLS match, the detection signal SDET1 is at the low level, otherwise the detection signal SDET1 is at the high level. When the segment electrode-for-display ESD1 is driven normally, the logic levels of SMNLS, SLAT, and SGQLS match. Accordingly, when a driving abnormality is detected, the detection signal SDET1 changes to the high level.

The OR circuit 164 obtains the logical sum of detection signals SDET1 to SDETn, and outputs a resulting detection signal SDETQ to the control circuit 120. n is an integer of 2 or more. SDET2 to SDETn are driving abnormality detection results of a segment electrode other than the segment electrode-for-display ESD1. When one of SDET1 to SDETn is at the high level, the detection signal SDETQ rises to the high level. When the detection signal SDETQ is at the high level, the control circuit 120 outputs an error detection signal to the display controller 410 via the interface circuit 125.

Figure 10:
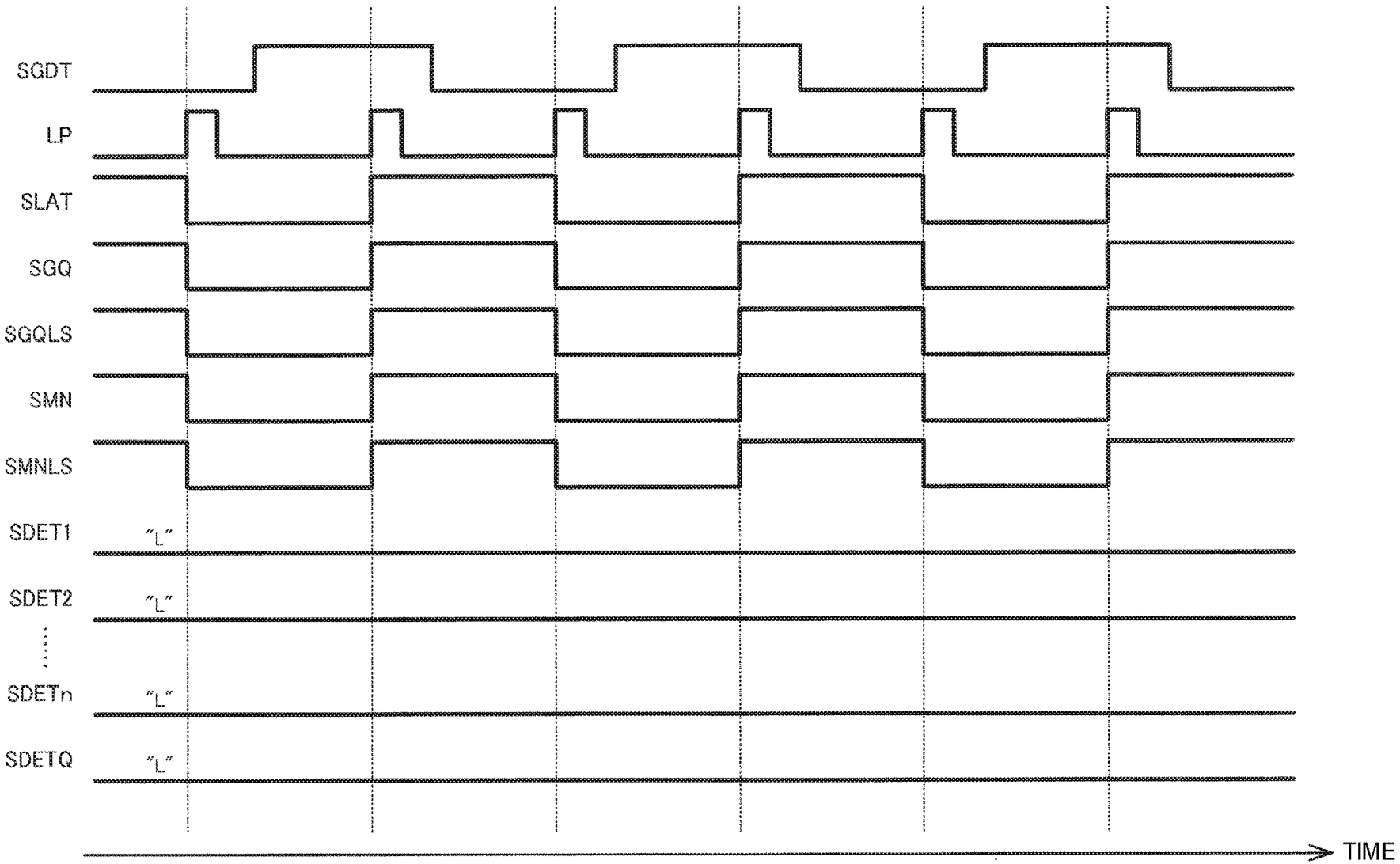
FIG. 10 shows an example of signal waveforms when a segment electrode-for-display is driven normally.

FIG. 10 shows an example of signal waveforms when the segment electrode-for-display ESD1 is driven normally. The latch circuit 153 outputs the segment signal SLAT by latching the output signal SGDT of the polarity reversing circuit 152 at a rising edge of the latch pulse LP. The output circuit 155 outputs the segment drive signal SGQ at the same logic level as the segment signal SLAT. When there is no driving abnormality, the logic level of the segment monitor signal SMN is the same as the logic level of the segment drive signal SGQ.

Therefore, the segment signal SLAT that is input to the exclusive OR circuit 163, the level-shifted segment monitor signal SMNLS, and the level-shifted segment drive signal SGQLS have the same logic level, Therefore, the exclusive OR circuit 163 outputs the detection signal SDET1 at the low level.

Here, assume that the detection signals SDET2 to SDETn are at the low level. The OR circuit 164 outputs, to the control circuit 120, the detection signal SDETQ at the low level, which is the logical sum of the detection signals SDET1 to SDETn.

Figure 11:
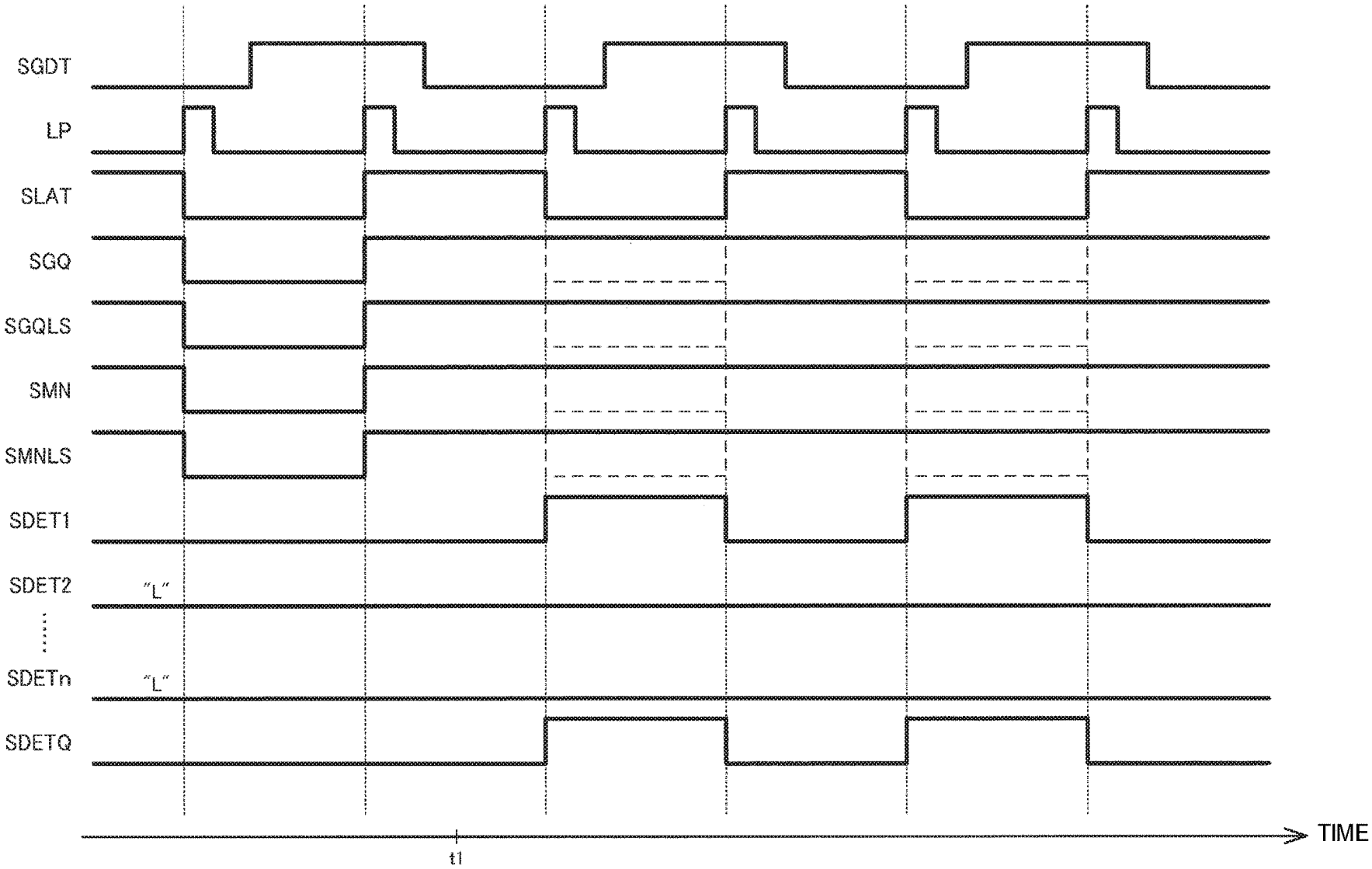
FIG. 11 shows an example of signal waveforms when an open state is entered between a segment terminal and the segment electrode-for-display.

FIG. 11 shows an example of signal waveforms when an open state is entered between the segment terminal TSD1 and the segment electrode-for-display ESD1. An open state occurs due to a connection failure of the segment terminal TSD1 or disconnection of the segment signal line LSD1. FIG. 11 shows an example of signal waveforms when the segment electrode-for-display ESD1 changes to a power supply potential due to charges accumulated in a parasitic capacitance. In FIG. 11, a dotted-line waveform represents the waveform in a normal case, and a solid-line waveform represents the waveform in the case of an abnormality.

Assuming that the segment signal line LSD1 enters an open state at a time t1, the segment drive signal SGQ is fixed at the high level at the time t1 and from thereon. When the segment signal SLAT is at the low level, the segment drive signal SGQ needs to be at the low level, but the segment drive signal SGQ changes to the high level due to short-circuiting.

As a result of the segment drive signal SGQ being fixed at the high level, the level-shifted segment drive signal SGQLS, the segment monitor signal SMN, and the level-shifted segment monitor signal SMNLS change to the high level. Therefore, when the segment signal SLAT is at the low level, the exclusive OR circuit 163 outputs the detection signal SDET1 at the high level. When the detection signal SDET1 is at the high level, the OR circuit 164 outputs the detection signal SDETQ at the high level. When the detection signal SDETQ at the high level is input, the control circuit 120 determines that a display abnormality has occurred.

According to the above embodiment, when a display abnormality in the first electro-optical panel 201 is detected by the first display driver 101, the second display driver 102 can drive the segment electrodes-for-display ESD1 and ESD2 via the segment signal lines LSD2 and LSD4. With such a configuration, even if the first display driver 101 cannot drive the first electro-optical panel 201, display on the first electro-optical panel 201 can be continued by the second display driver 102 outputting a drive voltage to the segment electrode-for-display of the first electro-optical panel 201.

In addition, similarly, when a display abnormality in the first electro-optical panel 201 is detected by the first display driver 101, the second display driver 102 can drive the segment electrode-for-transmittance-control ESHT via the segment signal line-for-transmittance-control LSHT2. With such a configuration, even when the first display driver 101 cannot drive the first electro-optical panel 201, a display image on the second electro-optical panel 202 can be transmitted by the second display driver 102 outputting a drive voltage to the segment electrode for transmittance control of the first electro-optical panel 201.

5. Electronic Device and Mobile Object

Figure 12:
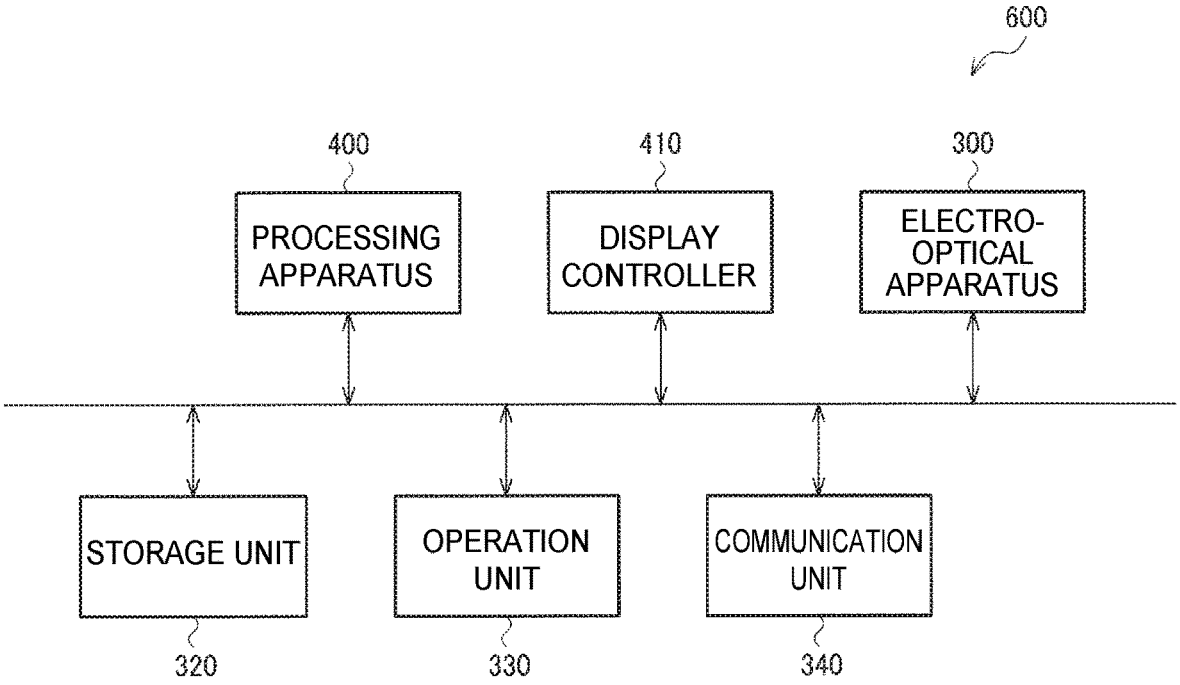
FIG. 12 shows a configuration example of an electronic device.

FIG. 12 shows a configuration example of an electronic device 600 that includes the electro-optical apparatus 300 of this embodiment. The electronic device of this embodiment may be any of various electronic devices equipped with the electro-optical apparatus. For example, the electronic device of this embodiment may be an on-board apparatus, a display, a projector, a television apparatus, an information processing apparatus, a portable information terminal, a car navigation system, a portable game terminal, a DLP (Digital Light Processing) apparatus, or the like. The on-board apparatus is an on-board display apparatus such as a cluster panel. The cluster panel is a display panel provided in front of a driver's seat, and meters and the like are displayed thereon.

The electronic device 600 includes the processing apparatus 400, the display controller 410, the electro-optical apparatus 300, a storage unit 320, an operation unit 330, and a communication unit 340. Note that the storage unit 320 is a storage apparatus or a memory. The operation unit 330 is an operation apparatus. The communication unit 340 is a communication apparatus.

The operation unit 330 is a user interface that receives various operations from the user. For example, the operation unit 330 is constituted by buttons, a mouse, a keyboard, a touch panel, and the like. The communication unit 340 is a data interface for performing communication of display data, control data, and the like. For example, the communication unit 340 is a wired communication interface such as a USB, or a wireless communication interface such as a wireless LAN. The storage unit 320 stores display data input from the communication unit 340. Alternatively, the storage unit 320 functions as a working memory of the processing apparatus 400. The processing apparatus 400 performs control processing of constituent elements of the electronic device and various types of data processing. The processing apparatus 400 transfers display data received by the communication unit 340 or display data stored in the storage unit 320 to the display controller 410. The display controller 410 converts the received display data into data of a format that can be received by the electro-optical apparatus 300, and outputs the converted display data to the electro-optical apparatus 300. The electro-optical apparatus 300 displays an image based on display data transferred from the display controller 410.

Figure 13:
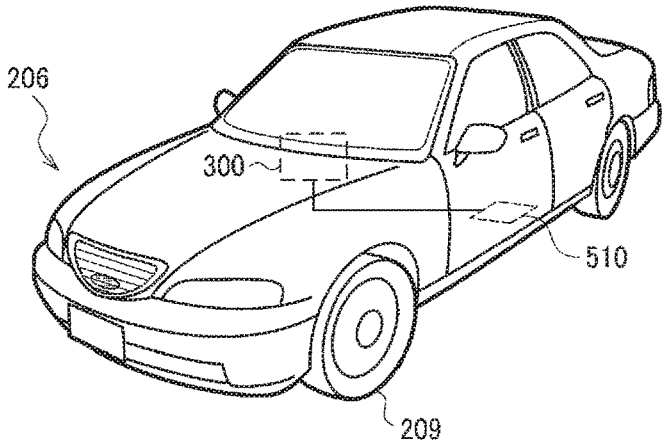
FIG. 13 shows an example of a mobile object.

FIG. 13 shows a configuration example of a mobile object that includes the electro-optical apparatus 300 of this embodiment. The mobile object is a device or an apparatus that moves on ground, in the air, or on sea, and includes, for example, a driving mechanism such as an engine or a motor, a steering mechanism such as a steering wheel or a rudder, and various types of electronic devices. The mobile object of this embodiment may be, for example, any of various mobile objects such as a vehicle, an aircraft, a motorcycle, a marine vessel, a running robot, and a walking robot. FIG. 13 schematically shows an automobile 206 that is a specific example of the mobile object. The automobile 206 includes the electro-optical apparatus 300 and a control apparatus 510 that controls the units of the automobile 206. The control apparatus 510 generates an image for presenting, to the user, information such as a vehicle speed, a fuel residual amount, a running distance, and settings of various apparatuses, transmits the image to the electro-optical apparatus 300, and displays the image on the electro-optical apparatus 300. Alternatively, a configuration may also be adopted in which the automobile 206 includes headlights, and the control apparatus 510 controls the electro-optical apparatus 300 of the headlights.

The above-described electro-optical apparatus includes a first electro-optical panel that is a segment panel, a first display driver that drives the first electro-optical panel, a second electro-optical panel that is a matrix panel, and is arranged to overlap the first electro-optical panel in planar view of the first electro-optical panel, and a second display driver that displays an image on the second electro-optical panel by driving the second electro-optical panel. The first electro-optical panel is arranged on a side from which the image is visually recognizable. The second display driver outputs a drive voltage to a segment electrode of the first electro-optical panel.

With such a configuration, at least a portion of the first electro-optical panel can be driven by a drive voltage being output to the segment electrode of the first electro-optical panel by the second display driver that drives the second electro-optical panel that is a matrix panel. Accordingly, even if an abnormality occurs in the first display driver that drives the first electro-optical panel, at least a portion of the first electro-optical panel can be driven from the second display driver.

In addition, in this embodiment, the first electro-optical panel may include a segment electrode for transmittance control, in a transmittance control region that is a region overlapping the image in the planar view. The second display driver may control light transmissivity of the transmittance control region by outputting the drive voltage to the segment electrode for transmittance control.

With such a configuration, even if an abnormality occurs in the first display driver that drives the first electro-optical panel, the second display driver can output a drive voltage to the segment electrode for transmittance control. Accordingly, light of a display image on the second electro-optical panel is transmitted through the transmittance control region, and thus the display image on the second electro-optical panel can be visually recognized.

In addition, in this embodiment, the second display driver may output, to the segment electrode for transmittance control, a first drive voltage for changing the transmittance control region to a light transmissive state, or a second drive voltage for changing the transmittance control region to a non-light transmissive state.

With such a configuration, the second display driver can control the liquid crystal of the transmittance control region in which the segment electrode for transmittance control is arranged, between two states, namely the transmissive state and the non-transmissive state.

In addition, in this embodiment, the second display driver may output one of a plurality of drive voltages for performing gradation control of the transmissivity, to the segment electrode for transmittance control.

With such a configuration, the second display driver can perform gradation control of the light transmissivity of the liquid crystal in a region in which the segment electrode for transmittance control is arranged. As a result of performing gradation control of transmissivity when the light of a display image on the second electro-optical panel is transmitted through the transmittance control region, the brightness of the display image on the second electro-optical panel can be suitably changed.

In addition, in this embodiment, the first electro-optical panel may include a segment electrode-for-display corresponding to a display item of the first electro-optical panel. If a display abnormality in the display item of the first electro-optical panel is detected, the second display driver may display an image corresponding to the display item, on the second electro-optical panel.

With such a configuration, when a display item of the first electro-optical panel is not displayed due to the occurrence of a display abnormality in the first electro-optical panel, an image corresponding to the display item of the first electro-optical panel can be displayed on the second electro-optical panel by the second display driver.

In addition, in this embodiment, the display item may be an icon.

With such a configuration, when an icon of the first electro-optical panel is not displayed due to the occurrence of a display abnormality in the first electro-optical panel, an image corresponding to the icon of the first electro-optical panel can be displayed on the second electro-optical panel by the second display driver.

In addition, in this embodiment, the display item may be an alarm lamp, a meter, or a numeral.

With such a configuration, when an alarm lamp, a meter, or a numeral of the first electro-optical panel is not displayed due to the occurrence of a display abnormality in the first electro-optical panel, the second display driver can display, on the second electro-optical panel, an image corresponding to the alarm lamp, meter, or numeral of the first electro-optical panel.

In addition, in this embodiment, the first electro-optical panel may include a segment electrode-for-display corresponding to a display item of the first electro-optical panel, a first segment signal line that connects the segment electrode-for-display and the first display driver, and a second segment signal line that connects the segment electrode-for-display and the second display driver.

With such a configuration, the second display driver can output a drive voltage to the segment electrode-for-display via the second segment signal line.

In addition, in this embodiment, when a display abnormality in the first electro-optical panel is detected, the second display driver may drive the segment electrode-for-display via the second segment signal line.

With such a configuration, when no display abnormality in the first electro-optical panel is detected, the first display driver can output a drive voltage to the segment electrode-for-display via the first segment signal line, and, when a display abnormality in the first electro-optical panel is detected, the second display driver can drive the segment electrode-for-display via the second segment signal line.

In addition, in this embodiment, the display item may be an icon.

With such a configuration, when no display abnormality in the first electro-optical panel is detected, the first display driver can display the icon of the first electro-optical panel, and when a display abnormality in the first electro-optical panel is detected, the second display driver can display the icon of the first electro-optical panel.

In addition, in this embodiment, the display item may be an alarm lamp, a meter, or a numeral.

With such a configuration, when no display abnormality in the first electro-optical panel is detected, the first display driver can display the alarm lamp, the meter, or the numeral of the first electro-optical panel, and when a display abnormality in the first electro-optical panel is detected, the second display driver can display the alarm lamp, the meter, or the numeral of the first electro-optical panel.

In addition, in this embodiment, the electro-optical apparatus may include a circuit substrate connected to the first display driver and the second display driver. The circuit substrate may include a signal line that connects the second display driver and a segment signal line connected to the segment electrode in the first electro-optical panel.

With such a configuration, the second display driver and the segment signal line connected to a segment electrode in the first electro-optical panel can be connected via the signal line provided on the circuit substrate. Accordingly, the second display driver can output a drive voltage to the segment electrode.

In addition, in this embodiment, a display control system may include the above-described electro-optical apparatus and a display controller. The display controller may include a first interface circuit that performs communication with the first display driver and a second interface circuit that performs communication with the second display driver.

With such a configuration, the display controller can control the first display driver via the first interface circuit, and can control the second display driver via the second interface circuit. Accordingly, the display controller can control the electro-optical apparatus in which the first electro-optical panel that is a segment panel and the second electro-optical panel that is a matrix panel are combined.

In addition, in this embodiment, a display driver may include a first drive terminal group connected to a first electro-optical panel that is a segment panel, a first drive circuit that drives the first electro-optical panel via the first drive terminal group, a second drive terminal group connected to a second electro-optical panel that is a matrix panel, and a second drive circuit that drives the second electro-optical panel via the second drive terminal group.

With such a configuration, the display driver that drives the second electro-optical panel that is a matrix panel, via the second drive terminal group can output a drive voltage to a segment electrode provided in the first electro-optical panel that is a segment panel, via the first drive terminal group In addition, in this embodiment, the first electro-optical panel may include a segment electrode for transmittance control that overlaps the second electro-optical panel in planar view of the first electro-optical panel. The first drive circuit may control transmissivity when a display image on the second electro-optical panel is transmitted through the first electro-optical panel, by outputting the drive voltage to the segment electrode for transmittance control.

With such a configuration, even when a display abnormality occurs in the first electro-optical panel, the second drive circuit can output a drive voltage to the segment electrode for transmittance control, and thus a display image on the second electro-optical panel is transmitted through the segment electrode for transmittance control so as to be visually recognizable.

In addition, in this embodiment, the first electro-optical panel can include a segment electrode-for-display corresponding to a display item of the first electro-optical panel. When a display abnormality in the first electro-optical panel is detected, the second drive circuit may display an image corresponding to the display item, on the second electro-optical panel.

With such a configuration, when a display item of the first electro-optical panel is not displayed due to the occurrence of a display abnormality in the first electro-optical panel, the second drive circuit can display, on the second electro-optical panel, an image corresponding to the display item of the first electro-optical panel.

In addition, an electronic device of this embodiment includes the above-described electro-optical apparatus.

In addition, a mobile object of this embodiment includes the above-described electro-optical apparatus.

The embodiments have been described in detail above, but those skilled in the art will readily understand that various modifications can be made without substantially departing from a new matter and effects of the disclosure. Accordingly, all of such modifications are encompassed in the scope of the disclosure. For example, a term described together with a different term having a broader meaning or the same meaning at least once in the specification or drawings may be replaced by the different term anywhere in the specification or drawings. Also, all combinations of the embodiments and modifications are also encompassed in the scope of the disclosure. In addition, the configurations and operations of the first electro-optical panel, the first display driver, the second electro-optical panel, the second display driver, the electro-optical apparatus, the display controller, the display control system, the electronic device, and the mobile object are not limited to those described in the embodiments, and various modifications can be made thereto.

What is claimed is:

1. An electro-optical apparatus comprising:

a first electro-optical panel that is a segment panel, the first electro-optical panel including:

a segment electrode in a transmittance control region, for transmittance control; and a segment electrode-for-display corresponding to a display item of the first electro-optical panel;

a first display driver configured to drive the first electro-optical panel;

a second electro-optical panel that is a matrix panel, and overlaps the first electro-optical panel in planar view of the first electro-optical panel; and a second display driver configured to:

display an image on the second electro-optical panel by driving the second electro-optical panel;

output a drive voltage to the segment electrode of the first electro-optical panel;

control light transmissivity of the transmittance control region by outputting the drive voltage to the segment electrode for transmittance control; and if a display abnormality in the display item of the first electro-optical panel is detected, display an image corresponding to the display item, on the second electro-optical panel, wherein the first electro-optical panel is arranged on a side from which the image is visually recognizable, and the transmittance control region overlaps the image in the planar view.

2. The electro-optical apparatus according to claim 1, wherein the second display driver is configured to output, to the segment electrode for transmittance control, a first drive voltage for changing the transmittance control region to a light transmissive state, or a second drive voltage for changing the transmittance control region to a non-light transmissive state.

3. The electro-optical apparatus according to claim 1, wherein the second display driver is configured to output one of a plurality of drive voltages for performing gradation control of the transmissivity, to the segment electrode for transmittance control.

4. The electro-optical apparatus according to claim 1, wherein the display item is an icon.

5. The display driver according to claim 1, wherein the display item is an alarm lamp, a meter, or a numeral.

6. The electro-optical apparatus according to claim 1, wherein the first electro-optical panel includes:

a first segment signal line that connects the segment electrode-for-display and the first display driver, and a second segment signal line that connects the segment electrode-for-display and the second display driver.

7. The electro-optical apparatus according to claim 6, wherein, when a display abnormality in the first electro-optical panel is detected, the second display driver is configured to drive the segment electrode-for-display via the second segment signal line.

8. The electro-optical apparatus according to claim 6, wherein the display item is an icon.

9. The display driver according to claim 6, wherein the display item is an alarm lamp, a meter, or a numeral.

10. The electro-optical apparatus according to claim 1, further comprising a circuit substrate connected to the first display driver and the second display driver, wherein the circuit substrate includes a signal line that connects the second display driver and a segment signal line connected to the segment electrode in the first electro-optical panel.

11. A display control system comprising:

the electro-optical apparatus according to claim 1; and a display controller that includes a first interface circuit configured to perform communication with the first display driver and a second interface circuit configured to perform communication with the second display driver.

12. A display driver comprising:

a first drive terminal group configured to connect to a first electro-optical panel that is a segment panel, the first electro-optical panel including:

a segment electrode for transmittance control; and a segment electrode-for-display corresponding to a display item of the first electro-optical panel;

a first drive circuit configured to drive the first electro-optical panel via the first drive terminal group;

a second drive terminal group configured to connect to a second electro-optical panel that is a matrix panel; and a second drive circuit configured to:

drive the second electro-optical panel via the second drive terminal group; and when a display abnormality in the first electro-optical panel is detected, display an image corresponding to the display item, on the second electro-optical panel, wherein the segment electrode overlaps the second electro-optical panel in planar view of the first electro-optical panel, and the first drive circuit is configured to control transmissivity when a display image on the second electro-optical panel is transmitted through the first electro-optical panel, by outputting a drive voltage to the segment electrode for transmittance control.

13. An electronic device comprising:

the electro-optical apparatus according to claim 1.

14. A mobile object comprising:

the electro-optical apparatus according to claim 1.

* * * * *